United States Patent [19]

Giordani et al.

[11] Patent Number: 4,893,609

[45] Date of Patent: Jan. 16, 1990

[54] WIND-RESISTANT OUTDOOR HEATING APPLIANCE

[75] Inventors: Attilio G. Giordani, Panorama City, Calif.; Jack W. Sargeant, East Greenwich, R.I.

[73] Assignee: Teledyne Industries, Inc., Los Angeles, Calif.

[21] Appl. No.: 912,519

[22] Filed: Sep. 26, 1986

[51] Int. Cl.[4] ..... F23I 11/00

[52] U.S. Cl. ..... 126/350 R; 126/307 R; 126/85 R; 126/85 B; 126/307 A; 98/79

[58] Field of Search ..... 126/350 R, 307 R, 307 A, 126/66, 77, 85 R, 85 B, 101; 122/367 R; 98/36, 78, 79

[56] References Cited

U.S. PATENT DOCUMENTS

| | | | |
|---|---|---|---|
| 2,651,299 | 9/1953 | Brown, Jr. | 126/85 |
| 2,811,095 | 10/1957 | Moran | 98/62 |
| 3,082,758 | 3/1963 | Heiman | 126/110 |
| 3,421,482 | 1/1969 | Ortega | 122/264 |
| 3,504,661 | 4/1970 | Morris et al. | 126/85 B X |
| 3,536,060 | 10/1970 | Block | 126/307 A |
| 3,623,458 | 11/1971 | Block | 122/264 |
| 3,797,477 | 3/1974 | Ramey | 126/307 A |
| 3,800,748 | 4/1974 | Schindler et al. | 126/307 A |
| 3,824,986 | 7/1974 | Ramey | 126/360 |
| 3,874,363 | 4/1975 | Biedenbender et al. | 126/85 B |
| 4,461,273 | 7/1984 | Barker et al. | 126/77 |
| 4,501,232 | 2/1985 | Gordbegli et al. | 122/235 C |
| 4,580,548 | 4/1986 | Ono | 126/307 A |

*Primary Examiner*—Carl D. Price

*Attorney, Agent, or Firm*—Benoit Law Corporation

[57] ABSTRACT

An outdoor heating appliance includes a top structure having a top surface, a stationary airfoil, and exhaust openings for flue products. The operation of the heating appliance is rendered wind resistant by generating with the stationary airfoil, in a region above the top surface and in repsonse to wind, an air pressure lower than an air pressure of that wind, and by locating the exhaust openings in that region, whereby the flue products are exhausted from the outdoor heating appliance by the wind. An inlet opening may be provided below the top surface at the airfoil for receiving part of the wind, in order to sustain combustion and generate inside the heating appliance positive pressure toward the exhaust openings by guiding air from the received part of the wind through a channel to a burner in the heating appliance.

53 Claims, 9 Drawing Sheets

WIND-RESISTANT OUTDOOR HEATING APPLIANCE

BACKGROUND OF THE INVENTION

1. Field of the Invention

The subject invention relates to heaters and heating systems and, more specifically, to pool heaters and other outdoor heating appliances and to methods of rendering the operation of such appliances wind resistant.

2. Information Disclosure Statement

The following disclosure statement is made pursuant to the duty of disclosure imposed by law and formulated in 37 CFR 1.56(a). No representation is hereby made that information thus disclosed in fact constitutes prior art, inasmuch as 37 CFR 1.56(a) relies on a materiality concept which depends on uncertain and inevitably subjective elements of substantial likelihood and reasonableness and inasmuch as a growing attitude appears to require citation of material which might lead to a discovery of pertinent material though not necessarily being of itself pertinent. Also, the following comments contain conclusions and observations which have only been drawn or become apparent after conception of the subject invention or which contrast the subject invention or its merits against the background of developments which may be subsequent in time or priority.

U.S. Pat. No. 2,651,299, by J. W. Brown, issued Sept. 8, 1953, discloses a gas burning heater having a backdraft diverter.

U.S. Pat. No. 2,811,095, by W. O. Moran, issued Oct. 29, 1957, discloses a positive draft controller supposed to assure a positive draft into a conduit or housing regardless of direct or relative wind conditions.

U.S. Pat. No. 3,082,758, by J. L. Heiman, issued Mar. 26, 1963, discloses a balanced draft space heater supposed to assure approximately equal air pressures at a flue gas outlet and a combustion air intake.

U.S. Pat. No. 3,421,482, by R. Ortega, issued Jan. 14, 1969, discloses an outdoor swimming pool heater having an upper air chamber containing four diagonally positioned air spacers, and a second air chamber connected to the upper air chamber and leading to an air passage contacting a burner chamber. Air is drawn from the air passage in a hole in the burner chamber, and a baffle within the burner chamber directs the flow of incoming air to a level below that of the burner.

U.S. Pat. No. 3,623,458, by L. Block, issued Nov. 30, 1971, discloses a stackless outdoor heater adapted for swimming pools in which openings are provided at the upper part of the appliance for admitting amospheric air for combustion and allowing it to mix with and dilute flue products before being discharged to keep the appliance cool. Around the upper part of the unit is a baffle member in the form of a collar preventing direct effect of wind velocity on the openings. The heater is provided with an air jacket with openings on one or more sides to admit air for combustion and to admit convection cooling air for keeping the unit cool.

U.S. Pat. No. 4,461,273, by A. Barker et al, issued July 24, 1984, discloses a slow combustion stove having an air inlet to enable air to circulate within the stove adjacent a deflector which deflects incoming air over a transparent portion enabling vision into a primary combustion zone.

U.S. Pat. No. 4,501,232, by M. Gordbegli et al, issued Feb. 26, 1985, discloses a pool or spa water heater having a heat exchanger including inner and outer metal tubes for transferring heat from the outer to the inner tubes and then to water flowing in the inner tube or tubes, with such tubes having metal to metal contact, whereby condensation of moisture from the products of combustion on exposed surfaces carried by the outer tubes is reduced.

In practice, many failures of appliances result from their exposure to harsh environmental conditions. In this respect, weather influences may often be handled by the use of proper materials to insure protection of internal components and inhibit oxidation on exposed surfaces. However, this does not alleviate the effect of wind conditions. Particularly in the case of pool heaters and other outdoor heating appliances, wind may affect the products of combustion, producing too much carbon monoxide and causing flame roll-out resulting in damage to wiring and to controls in extreme cases.

In practice, the problem is aggravated by the fact that an outdoor heating appliance typically is exposed to wind from different directions and even downdrafts occurring along or caused by adjacent building surfaces. The above mentioned and other proposals and appliances as far as known do not solve these problems sufficiently.

U. S. Pat. No. 3,797,477, by R. M. Ramey, issued Mar. 19, 1974, discloses a gas-fired heating appliance which is convertible to indoor and outdoor use. To this end, that appliance requires an indoor flue stack assembly which is different from its outdoor grate vent assembly. These different assemblies are separately manufactured in the form of removable and replaceable heating appliance tops, which in practice not only manifests itself in higher costs, but also represents an inconvenience in terms of manufacture, stocking, installation and replacement.

U.S. Pat. No. 3,824,986, by R. M. Ramey, issued July 23, 1974, discloses a submersible pool heater for outdoor use.

U. S. Pat. No. 4,580,548, by B. K. Ono, issued Apr. 8, 1986, discloses a vent system for a gas-fired swimming pool heater, convertible from outdoor use to indoor use by replacement of three components or component assemblies. Flue products are dispersed and proper combustion is supported in a variety of adverse weather conditions by a provision of louvered sets of exhaust openings in a top panel, as well as lateral wind inlet clearances between a top cowling and an intermediate cowling and between that intermediate cowling a heater top. All wind thus received from the side either mixes with the flue products or exhausts itself directly, without sustaining combustion at the internal flames of the heating appliance, and without generating inside such heating appliance a positive pressure toward the exhaust openings.

SUMMARY OF THE INVENTION

It is a general object of this invention to meet the needs and to overcome the disadvantages expressed or implicit in the above Information Disclosure Statement or in other parts hereof.

It is a germane object of this invention to provide improved outdoor heating appliances and to improve their operation outdoors.

It is a related object of this invention to render the operation of outdoor heating appliances more resistant to winds and drafts from different directions.

It is a germane object of this invention to provide improved combustion in outdoor heating appliances during winds and drafts from different directions.

It is also an object of this invention to provide improved convertible indoor and outdoor appliances.

Other objects of the invention will become apparent in the further course of this disclosure.

From one aspect thereof, the subject invention resides in a method of providing and operating an outdoor heating appliance wherein internal flames produce flue products inside a housing of the heating appliance. The invention according to this aspect resides, more specifically, in the improvement of rendering the operation of the heating appliance wind resistant, comprising in combination the steps of providing the heating appliance above the housing with a top structure having a top surface, defining the top surface with a stationary airfoil generating in a region above the top surface and in response to wind an air pressure lower than an air pressure sure of that wind, providing below that top surface and; that airfoil inlet openings for receiving part of the wind, penetrating the top surface with exhaust openings for the flue products in the above mentioned region, whereby the flue products are exhausted from the outdoor heating appliance by the wind, and sustaining combustion generating the flue products inside the heating appliance and imparting to the flue products a positive pressure toward the exhaust openings aiding exhaustion of the flue products during occurrence of said wind by guiding air from the received part of the wind through a channel in the heating appliance to the internal flames. According to a preferred embodiment of this aspect of the invention, wind deflectors or diverters are provided inside the inlet openings and air from the received part of the wind is guided with such wind deflectors or diverters into and through the above mentioned channel in the heating appliance to the internal flames.

From a related aspect thereof, the subject invention resides in an outdoor heating appliance wherein internal flames produce flue products and, more specifically, resides in the improvement for rendering the operation of the heating appliance wind resistant, comprising in combination a top structure for the heating appliance having a top surface, a stationary airfoil preceding the top surface for generating in a region above the top surface and in response to wind an air pressure lower than an air pressure of that wind, inlet openings below the top surface and the airfoil for receiving part of the wind, means for sustaining combustion and generating inside the heating appliance positive pressure toward the exhaust openings during the wind, including a channel for guiding air from the received part of the wind to the internal flames, and exhaust openings for the flue products penetrating the top surface in the above mentioned region, whereby the flue products are exhausted from the outdoor heating appliance by the wind.

A preferred embodiment of the invention provides below the top surface and the airfoil an inlet opening for receiving part of the wind and sustains combustion and generates inside the heating appliance positive pressure towards the exhaust openings during such wind by guiding air from the received part of the wind through a channel in the heating appliance to the internal flames. The top structure is divided into a top chamber extending below the exhaust openings and a separate chamber communicating with the channel to the internal flames, and wind deflectors or diverters extend in that separate chamber between the inlet openings and that channel at predetermined angles with respect to front, side and rear portions of the top structure.

From another aspect thereof, the subject invention resides in a method of providing and operating an outdoor heating appliance wherein internal flames produce flue products and, more specifically, resides in the improvement of rendering the operation of the heating appliance wind resistant, comprising in combination the steps of providing the heating appliance with a top structure having a top surface, dividing that top structure into a top chamber extending below the top surface and a separate lower chamber located below that top chamber, providing wind diverters in the lower chamber at predetermined angles with respect to front, side and rear portions of the top structure, providing lower inlet openings in communication with that lower chamber for receiving a first part of the wind, sustaining combustion generating the flue products inside the heating appliance and imparting to the flue products a positive pressure aiding exhaustion of the flue products during occurrence of that wind by guiding air from the received first part of the wind with said wind diverters through part of the lower chamber and into a channel in the heating appliance to the internal flames, providing upper inlet openings in communication with the top chamber for receiving a second part of the wind, guiding the flue products into the top chamber, and penetrating the top surface with exhaust openings for the flue products and employing wind from said second part for exhausting the flue products from the top chamber through the exhaust openings.

From another related aspect thereof, the subject invention resides in an outdoor heating appliance wherein internal flames produce flue products inside a housing of the heating appliance and, more specifically resides in the improvement of rendering the operation of the heating appliance wind resistant, comprising in combination a top structure for the heating appliance above the housing having a top surface, means for dividing the top structure into a top chamber extending below the top surface and a separate lower chamber located below that top chamber, the means for dividing the top structure include an exhaust shield extending inside the top structure from front to back and from side to side between the top chamber and the lower chamber, the top structure has openings in sides thereof divided by the exhaust shield into lower inlet openings in communication with the lower chamber for receiving a first part of the wind, and upper inlet openings in communication with the top chamber for receiving a second part of the wind means for sustaining combustion generating the flue products inside the heating appliance and imparting to the flue products a positive pressure aiding exhaustion of the flue products during occurrence of that wind, including a channel in the heating appliance for guiding air from the received first part of the wind through part of the lower chamber to the internal flames, exhaust openings in the top surface, and means for guiding flue products into the top chamber for exhaustion of these flue products from that top chamber through said exhaust openings with wind from said second part.

The subject invention resides also in a convertible indoor/outdoor heating appliance wherein internal flames produce flue products and, more specifically resides in the improvement comprising in combination a top structure for the heating appliance having a top surface, means for dividing the top structure into a top chamber extending below the top surface and a separate lower chamber located below the top chamber, inlet openings in communication with the lower chamber for receiving air from outside the appliance, means for sustaining combustion inside the appliance including a channel in the appliance for guiding air from the inlet openings through part of the lower chamber to the internal flames, means for guiding flue products to the top chamber including a flue collector below the lower chamber and a pipe extending from the flue collector through the lower chamber to the top chamber, and exhaust openings in the top surface for exhaustion of flue products from the appliance.

According to a preferred embodiment of this aspect of the invention, the exhaust openings include an aperture through the top structure for receiving a flue stack extending through the top chamber to said pipe for guiding flue products away from the appliance.

Other aspects of the invention will become apparent in the further course of this disclosure, and no restriction to any object, aspect or feature is intended by this Summary of the Invention.

BRIEF DESCRIPTION OF THE DRAWINGS

The subject invention and its various objects and aspects will become more readily apparent from the following detailed description of preferred embodiments thereof, illustrated by way of example in the accompanying drawings, in which like reference numerals designate like or functionally equivalent parts, and in which:

FIG. 2 also shows a rheological flow pattern occurring in response to a side wind;

DESCRIPTION OF PREFERRED EMBODIMENTS

Figure 1:
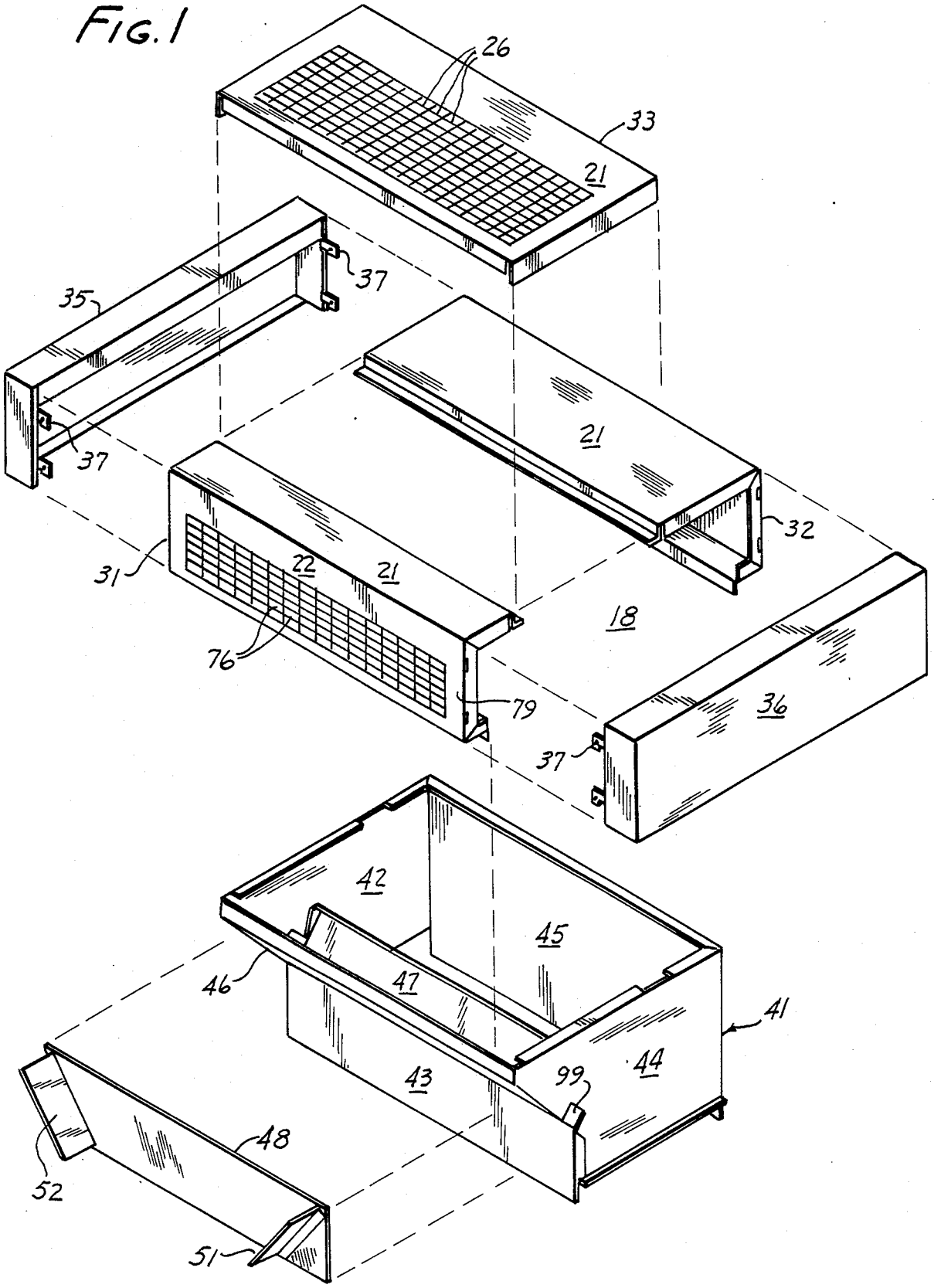
FIG. 1 is an exploded view of a heater top according to a preferred embodiment of the subject invention.

The heating appliance 10 includes a housing 12 having in the preferred embodiment shown in the drawings a closed bottom 13 and side walls 14, 15, 16 and 17 below a top structure 18. Dotted lines along the walls 14, 15, 16 and 17 indicate in FIG. 2 the preferred closed condition of these side walls. In this respect, two of these walls may also be designated as front wall 15 and rear wall 17, respectively, and part of the front wall may be formed by a panel 19 that is removable for access to internal parts of the heating appliance, but preferably is solid, so as to complete the closed front wall 15 in the operating position of the heating appliance 10.

The subject invention renders the operation of the heating appliance 10 wind resistant. To this effect, the subject invention provides the heating appliance with a top structure 18 having a top surface 21, and precedes that top surface with a stationary airfoil 22 generating in a region 23 above the top surface 21, and in response to wind 24, an air pressure 25 lower than the air pressure of the wind 24. The invention further penetrates the top surface 21 with exhaust opening 26 for flue products 27 in the region 23, whereby such flue products are exhausted from the outdoor heating appliance by wind 24.

FIG. 1 more specifically illustrates components of the heater top according to a preferred embodiment of the subject invention.

In particular, a composite heater top surface 21 is provided by top surfaces of angled front and rear sections 31 and 32 and by an intervening top panel 33 of the heater top structure. The heater top front section 31 also provides the stationary airfoil 22 for generating, in response to wind 24, the lower air pressure 25 in a region 23 above top surface 21, as explained with the aid of FIG. 3.

The illustrated top structure 18 further includes solid lateral sections 35 and 36 which may be connected to the front and rear sections 31 and 32 by any suitable kind of fasteners, some of which are indicated at 37, for instance.

The exhaust openings 26 which penetrate the top surface 21 in the reduced pressure region 23, may, for instance, be provided as a louvered structure.

According to the illustrated preferred embodiment, the top structure also includes an insert 41 providing inside the top structure or appliance separating walls 42, 43, 44 and 45 and baffles 46 and 47. A further baffle 48, with side wings 51 and 52, may also be considered as part of the top structure 18.

The insert 41 and baffle 48 may be mounted on internal separating or insulating wall structures 54, 55 and 56 of the heating appliance. The insert 42, in turn, may carry the heater top sections 31, 32, 33, 35 and 36 in spaced relationship to the heating appliance housing 12. In this respect, the appliance housing or housing proper may have a top collar 58 spaced inwardly at least from heater top sections 35 and 36, so as to leave, inside the heater top, lateral air channels, one of which is seen at 59 in FIG. 2.

The subject invention is not limited in scope to a particular type of heating appliance. However, FIGS. 2 to 4 of the drawings show the heating appliance 10 as having a gas burner 61 mounted in a lower part thereof. That burner is supplied with combustible gas through a control valve and pipe assembly 62 and 63. Upon ignition, the burner provides gas flames 64 generating heat in the heater chamber 65. By way of example, that heat may be employed for heating another medium, such as air, water, oil, etc. Heating appliances according to the subject invention may thus be employed for various purposes. However, the illustrated preferred embodiments of the invention are more specifically concerned with an outdoor heating appliance.

A prototype of the illustrated embodiment has been designed as a swimming pool heater, which currently is the best mode contemplated for carrying out the subject invention. Accordingly, pipes of a heat exchanger 66 are shown in the upper part of the appliance or fire chamber 65. In the operation of the heating appliance, internal flames 64 produce flue products 27 which heat the water 68 in the heat exchanger 66 and which are exhausted through top openings 26 as described above, and as still more fully described below.

Figure 2:
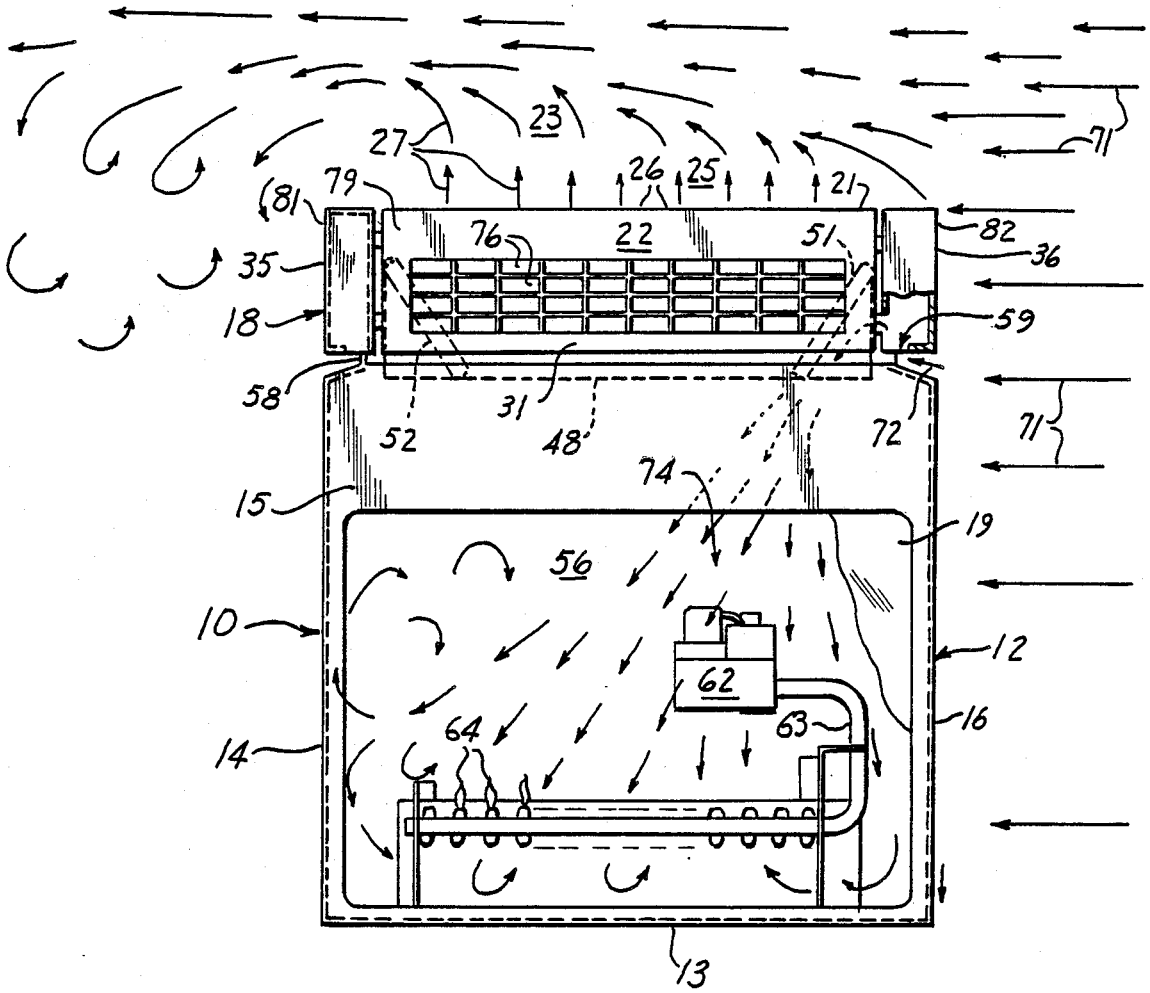
FIG. 2 is a front view of a heating appliance having the heater top of FIG. 1 assembled thereon, and having a solid front panel partially broken away to show internal parts.

In this respect, FIG. 2 illustrates a situation in which a side wind 71 impinges upon the heating appliance. As indicated by arrows 72, air from the side wind 71 is able to enter the appliance through the inlet opening 59 between the top structure 18 and a remainder 58, etc., of the heating appliance below that top structure. Baffle 51 directs the side wind downwardly to the burner section. Essentially the same supply of air to the burner section would occur if the side wind were to impinge from the opposite direction in which case air from the side wind would enter the appliance at an inlet opening between the heater top 18 or lateral section 35 and the collar 58.

In that case, the baffle 52 would direct such inlet air downwardly to the burner section.

Accordingly, the illustrated embodiment of the invention provides the heating appliance 10 with a housing 12 having a closed bottom 13 and side walls 14, 15, 16 and 17 below the top structure 18, and provides inlet openings 59, etc. below the top surface 21 and the airfoil 22 for receiving part of the wind. The preferred embodiment of the invention maintains the bottom and all side walls of the housing 12 closed below the top structure, and sustains combustion and generates inside the heating appliance positive pressure towards the exhaust openings 26 during the wind by guiding air from the received part of the wind through a channel 74 in the heating appliance to the burner section or internal flames 64.

FIGS. 1 and 2 illustrate another way of providing below the top surface 21 and the airfoil 22 an inlet opening for receiving part of the wind. In particular, the embodiment shown in FIGS. 1 and 2 provides such inlet opening or openings 76 in a lower part of the angled front top section 31, below the airfoil 22. A louvered structure may be provided for that purpose.

Figure 3:
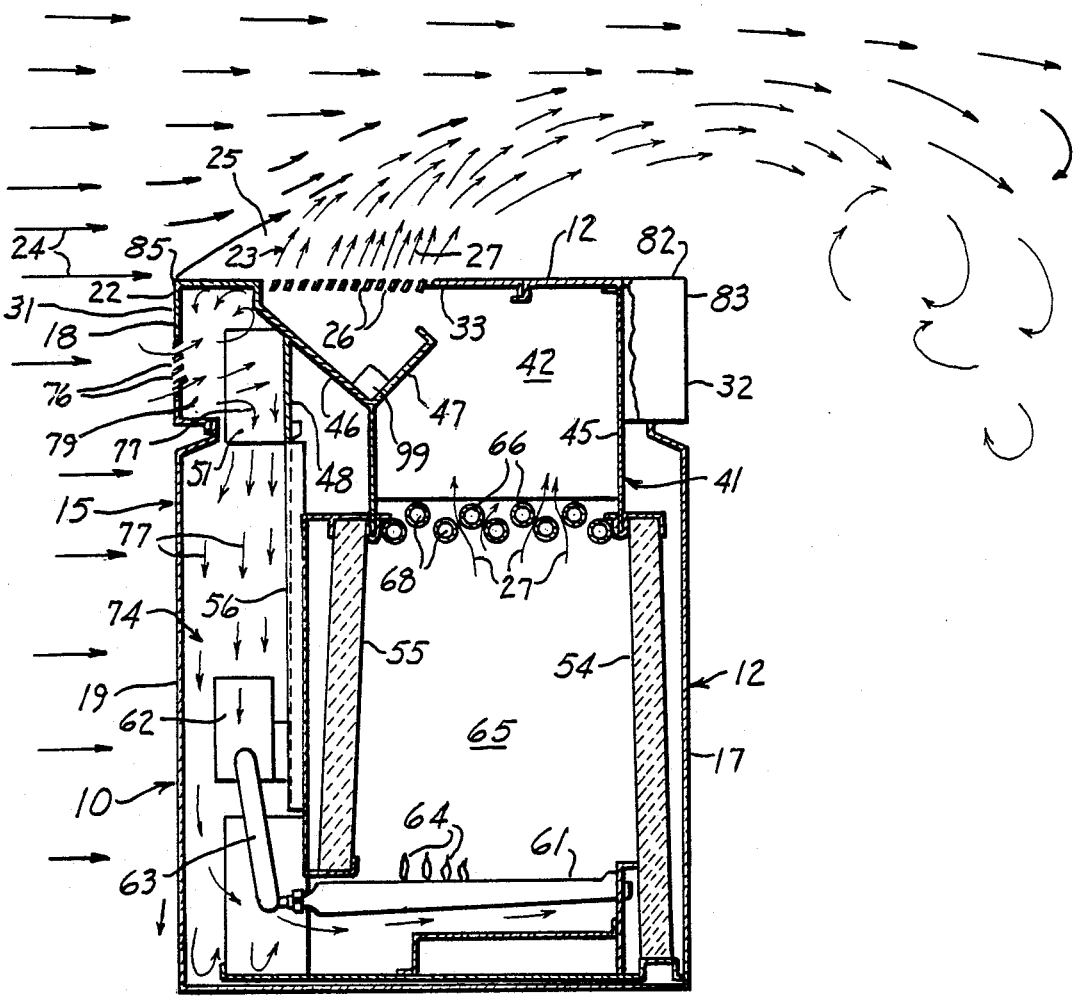
FIG. 3 shows a section of the heating appliance of FIG. 2 in side view, and a rheological flow pattern resulting from a front wind condition.

As shown in FIG. 3 by arrows 77, air from the frontal wind 24 enters the frontal inlet openings 76 to be guided downwardly at baffles 46 and 48 and internal separating wall 56 to the burner section in the lower part of the appliance, whereby that guided part of the wind sustains combustion and generates inside the heating appliance a positive pressure towards the exhaust openings, so as to aid in the exhaustion of flue products 27 from the appliance.

In practice, that positive pressure cooperates in the operation of the appliance and exhaustion of flue products with the above mentioned negative or lower pressure generated in the region 23 by airfoil 22 and wind 24.

A similar effect is brought about when the inlet opening is provided between the top structure 18 and a remainder 59, etc., of the heating appliance below that top structure, as shown at 59, for instance. The illustrated preferred embodiment of the invention thus provides inlet openings in or at a side of the top structure 18, such as shown at 59 or at 76 or at both 59 and 76.

An illustrated preferred embodiment of the invention provides in a frontal side 79 of the top structure 18, below the top surface 21 and the airfoil 22, first inlet openings 76 for receiving part of a frontal wind 24, and sustains combustion and generates inside the heating appliance 10 positive pressure toward the exhaust openings 26 during the frontal wind, by guiding air 77 from the received part of the frontal wind 24 through a first channel 74 in the heating appliance to the internal flames 64. That preferred embodiment also provides between lateral sides of the top structure 18 and the housing 12 second inlet openings 59 for receiving air from side winds 71, and sustaining combustion and generating inside the heating appliance 10 positive pressure towards the exhaust openings 26 during wind 71 by guiding air 72 received from that side wind to the internal flames 64, such as through the channel 74 or through a second channel in the heating appliance.

The illustrated preferred embodiment of the invention maintains the bottom 13 and all the side walls 14, 15, 16 and 17 of the housing 12 closed below the installed top structure 18. This is an important feature which distinguishes the illustrated preferred embodiment from such prior-art proposals as those of the above mentioned U.S. Pat. No. 3,623,458, by L. Block, in which a heater housing is provided with louvered openings in upper and lower portions of its sides to admit air for combustion and to admit convection air for keeping the unit cool. Most air thus admitted appears to rise upwardly, rather than flowing downwardly to a combustion and to establish inside the heating appliance or fire chamber significant positive pressure to aid in the exhaustion of flue products.

The illustrated preferred embodiment also precedes the top surface 21 with stationary airfoils 81, 82 and 83 at the sides or side elements 35 and 36 and at the rear or rear element 32 of the top structure 18. In practice, these additional airfoils perform a function similar to that of the frontal airfoil 22 described above with the aid of FIG. 3.

By way of example, as shown in FIG. 2, the lateral airfoil 82 generates in region 23 above the top surface 21, and in response to side winds 71, an air pressure lower than the air pressure of that wind, whereby flue products 27 are exhausted from the heating appliance by the side wind 71 through the top openings 26 in the heater top 18. Essentially the same occurs in response to side winds impinging on the heating appliance from the left, as seen in FIG. 2, whereby the lateral airfoil 81 aids in the provision of negative or lower air pressure in the top region 23 and thereby in the exhaustion of flue products 27 from the heater 10.

Like the front wind 24, side winds 71, etc., thus not only contribute oxygen or air of combustion to the burner 61 or flames 64, but also aid in the exhaustion of flue products, both in proportion to wind velocity or strength. Preferably, such winds not only aid in the exhaustion of flue products by establishing a negative or lower pressure above the exhaust openings 26, but also by establishing a positive or higher pressure in the burner chamber 65. Appropriate baffles 46 to 48, 51 and 52 may be provided for control and achievement of a well-balanced operation of these deliberate wind effects.

Again, operation of airfoils 22 and 81 to 83 according to the subject invention is just the opposite of the slanted shaping of the top regions of the heater top structure periphery according to the above mentioned U.S. Pat. No. 3,623,458, by L. Block, which effectively inhibits an airfoil action. Accordingly, the illustrated preferred embodiment of the subject invention provides the airfoil 22, 81, 82 or 83 at the top surface 12 with a straight edge 85 extending transversely to the wind for generating the lower air pressure 25.

Figure 4:
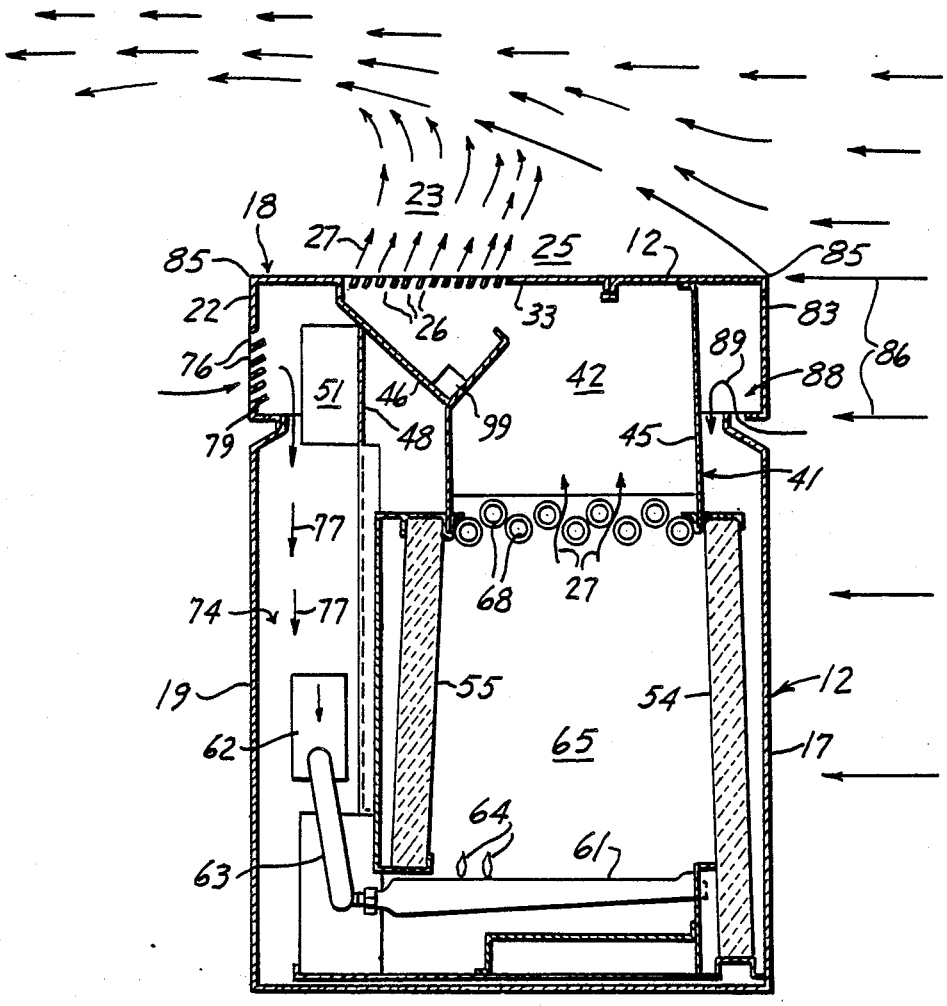
FIG. 4 is a view similar to FIG. 3, illustrating a rheological flow pattern occurring in response to a rear wind condition.

In a freestanding outdoor appliance, winds may also proceed toward the rear of the appliance as shown, for instance, in FIG. 4 at 86.

In that case, the rear top airfoil 83 with its straight edge 85 extending transversely to the wind 86 again generates the lower air pressure 25 in the region 23 for exhausting flue products 27 through top openings 26. Moreover, a rear inlet opening 88 may be employed for receiving part of the rear wind 86 or, in other words, air 89, which is directed downwardly by the rear wall or baffle 45 of the insert 41.

Like the lateral inlet opening or openings 59, the rear inlet opening 88 is located below the top structure 18 and a remainder 58 of the heating appliance below that top structure. In other words, the housing of the heating appliance comprising the bottom 13 and side walls 14, 15, 16 and 17, is maintained closed during the operation of the heating appliance, as already explained above.

The rear inlet opening 88 may be an extension of the lateral inlet opening or openings 59 and air 89 derived from the rear wind 86 may be guided along lateral channels and downwardly to the burner 61 to sustain combustion at flames 64.

However, from a consideration of FIG. 4 it should become apparent that there may be situations in which a desired design of the heater chamber and refractory wall 54 does not lend itself conveniently to the reception and guidance of air in that region. Accordingly, FIG. 4 discloses a further embodiment of the subject invention that may be employed in these and similar cases.

In particular, FIG. 4 shows how the stationary airfoil 83, with its transverse straight edge 85, generates not only the underpressure 25, which helps the exhaust of flue products 27, but generates also a whirl 91 which brings about a positive air pressure area 92 behind the top surface 21, as seen in the direction of the rear wind 86. In the embodiment of FIG. 4, that positive air pressure area 92 actually is located at the front side of the top structure 18, whereby air, derived from the rear wind 86 and its whirl 91, enters the air intake opening 76 at the front of the top structure.

Baffle 48, with its wings 51 and 52, guide such air from the intake 76 downwardly, so that it proceeds as indicated by arrows 77 like air received from a frontal wind, through the frontal channel 74 inside the appliance to the burners 61.

In other words, the embodiment illustrated in FIG. 4 generates with the airfoil 83 a positive air pressure area behind the top surface 12, as seen in the direction of wind 86, and provides below that top surface 12 in the positive air pressure area 92 one or more openings 76 for receiving part of the wind 86. That embodiment further sustains combustion at burners 61 for flames 64 and generates inside the heating appliance positive pressure towards the exhaust openings 26 during the wind 86, by guiding air from the received part 91 and 77 of that wind 86 through a channel 74 in the heating appliance to the internal flames 64. If desired, that principle may also be employed in the case of winds other than rear winds impinging on the appliance.

In practice, appliances of the type of heater 10 are not always freestanding. In fact, in the case of swimming pool heaters and other outdoor heating appliances, it is on the average likely that the heating appliance would be located near a building wall or other barrier 94. In that case, winds impinging upon such wall 94 generate downdrafts which disturb the operation of prior-art heating appliances. Especially, the exhaust of flue products is seriously impeded by downdrafts in prior-art structures.

Figure 5:
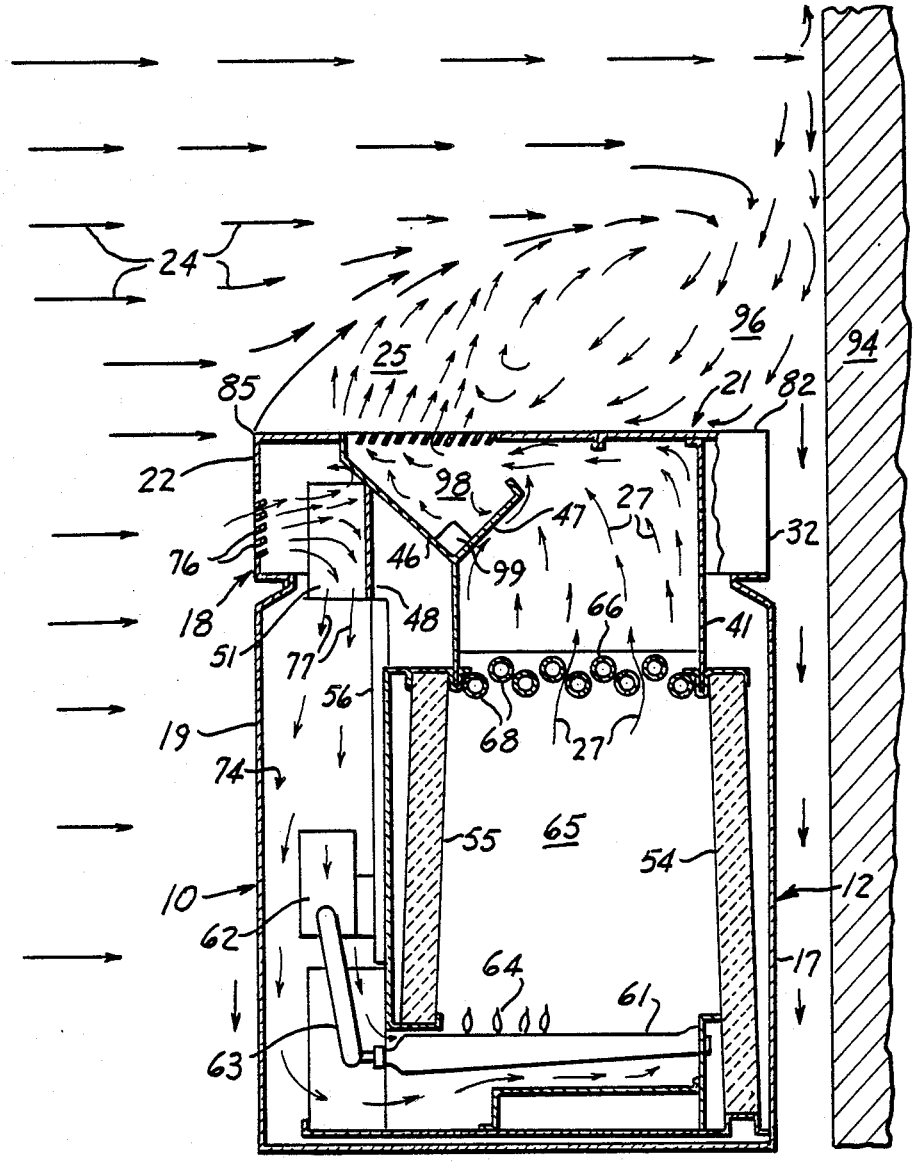
FIG. 5 is a view similar to FIG. 2, showing a rheological flow pattern occurring during a downward wind condition.

The view of FIG. 5 illustrates an embodiment of the subject invention in which these detrimental effects are successfully countered.

In particular, as seen in FIG. 5, a frontal wind 24 generates at the wall 94 a downdraft 96 which sweeps along the appliance top surface to the exhaust openings 26. In the illustrated embodiment, air from such downdraft is permitted to enter part of the exhaust openings 26. However, the baffle structure including baffles 46 and 47 provided inside the top structure 18 below the exhaust openings 26 effectively returns, through part of those exhaust openings, air which penetrates another part of these exhaust openings during downward wind conditions. In particular, the baffle structure 46 and 47 of the insert 42 generate below the exhaust openings 26 a whirl 98 which returns air from the downdraft 96 entraining flue products 27 therewith. In this manner, a downdraft actually aids in the exhaust of flue products from the appliance by some kind of Venturi or similar entrainment effect.

In the embodiment of FIG. 5, the latter effect is enhanced by the underpressure 25 generated from frontal wind 24 by the frontal airfoil 22 with its straight edge 85. In addition, air may also be received from the frontal wind 24 through the front intake openings 76, to be guided downwardly with the aid of baffles 48, 51 and 52 as described above, in order to aid in the combustion process at burners 61 and establishment of a positive pressure in the fire chamber 65.

Heaters according to the subject invention and its embodiments thus work well under all kind of wind conditions and in all kind of environments. In practice, the illustrated heater can also be used as an indoor appliance. In that case, the central panel 33 including the exhaust grille 26, may be replaced by a smokestack or chimney adaptor (not shown).

On the other hand, if the illustrated heater is employed as an outdoor appliance, then at least part of the provided internal baffle structure may be employed as a protection against the elements, including rain water and even water splashing from swimming pools, spas, sprinklers or garden hoses.

By way of example, and as apparent from FIGS. 1 and 3 to 5, the baffles 46 and 47 are arranged in a V-shaped configuration so as to form a trough therebetween for collecting water penetrating the top exhaust openings 26. Means, such as apertures 99, at the end of that trough may be employed for draining water therefrom. In practice, such water may either be conducted to the outside of the appliance, or may be permitted to sprinkle downwardly inside thereof, such as along or onto the hot refractory walls of the fire chamber. Of course, one or two suitable rain apertures may be provided for this purpose in the bottom 13. In practice, this does not detract from the fact that the bottom 13 is maintained closed as are the walls 14 to 17 of the appliance, since no significant air for sustaining combustion in the appliance would be drawn through those bottom drain holes.

The baffles 46 and 47 may thus serve the dual purpose of protecting the heater against downward wind conditions and of keeping rain and other water therefrom despite the presence of the top exhaust openings 26.

Even though the heating appliance according to the illustrated embodiments works well in all kind of wind conditions, it also operates perfectly when there is no or practically no wind, and it always generates good, acceptable flue products.

Figure 6:
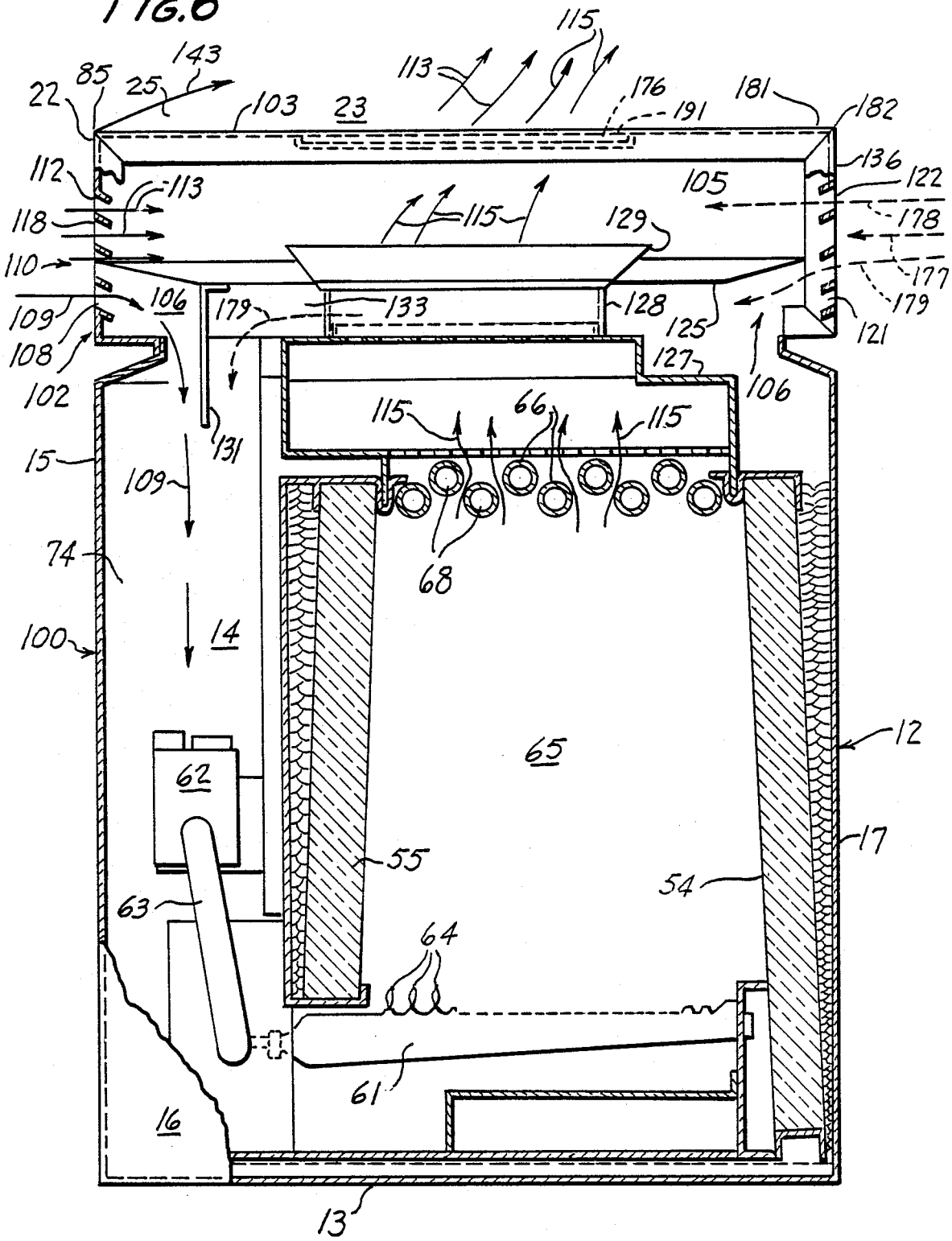
FIG. 6 is a section in side view, of a heating appliance according to the most preferred embodiment of the invention.

This applies also to the embodiments of FIGS. 6 et seq. In fact, that illustrated second embodiment of the subject invention employs principles disclosed above with respect to the illustrated first embodiment of FIGS. 1 to 5. However, the illustrated second embodiment according to FIGS. 6 et seq. embodies what is presently believed to be the best mode of carrying out the invention.

The heating appliance 100 shown in FIGS. 6 et seq. has a housing 12 which may be similar or identical in design and function as the housing of the appliance shown in FIGS. 1 to 5. In fact, the disclosure of FIGS. 1 to 5 may be consulted for the nature, function and operation of parts and components bearing like reference numerals as among FIGS. 1 to 5 and 6 et seq.

The heating appliance 100 is provided with a top structure 102 having a top surface 103. According to the currently discussed aspect of the subject invention, the top structure is divided into a top chamber, such as the chamber 105 extending below the top surface, and a separate lower chamber 106 located below the top chamber 105. Lower inlet openings 108 are provided in the top structure in communication with the lower chamber 106 for receiving a first part 109 of a wind 110.

Pursuant to the subject invention, combustion is sustained and a positive pressure generated inside the heating appliance during the wind 110 by guiding air from the received first part 109 of the wind through part of the lower chamber 106 and a channel 74 in the heating appliance to the internal flames 64.

The top structure 102 also provides upper inlet openings 112 in communication with the top chamber 105 for receiving a second part 113 of the wind 110.

Combustion or flue products 115 are guided into the top chamber 105 from the flames 64 in the heating appliance. The top surface is penetrated with exhaust openings 116 for the flue products 115 and wind from the second part 113 is employed for exhausting these flue products from the top chamber 105 through the exhaust openings in the top surface 103.

The upper and lower inlet openings 108 and 112 may be provided in a side of the top structure 102, such as in the frontal side 118 thereof. Within the scope of the subject invention, the upper and lower inlet openings may be distributed among more than one side of the top structure. For instance, the lower inlet openings 108 may be provided in one side, and the upper inlet openings 112 in another side of the top structure 102.

Groups of upper and lower inlet openings may also be provided in two or more sides of the top structure, such as shown at 108 and 112 and at 121 and 122, respectively, in FIG. 6.

As in the case of the heating appliance 10, the heating appliance 100 is provided with or includes a housing 12 having a closed bottom 13 and side walls 14, 15, 16 and 17 below the top structure 102, and maintains that bottom and all side walls of the housing closed below the top structure during operation of the heating appliance.

In other words, the heating appliance 100 has a housing structure which is completely closed below the top structure 102 or, in that illustrated preferred embodiment of the invention, below the air inlet openings in one or more sides of the top structure, such as the air inlet openings 108 and 121 shown in FIG. 6 laterally of the top structure.

In this manner, air inlet is controlled and dictated by the wind which thus creates a balance between air inlet and exhaust for optimum operation of the heating appliance and best quality of the combustion product for the environment.

Airfoils of the above mentioned type may also be employed in the heating appliance 100. For instance, the top surface 103 of the top structure 102 advantageously is preceded with a stationary airfoil 22 generating in a region 23 above the top surface 103, and in response to wind 110, an air pressure 25 lower than the air pressure of the wind, for exhausting flue products through exhaust openings 116, and thereby assisting the self-regulating action of wind 110 on the operation of the heating appliance. The airfoil 22 advantageously is provided with a straight edge 85 extending transversely to the wind for generating the lower air pressure 25, thereby greatly enhancing the mentioned self-regulating function.

In the illustrated preferred embodiment of the heating appliance 100, the means for dividing the top structure 102 include an exhaust shield 125 extending inside the top structure from front to back and from side to side between the top chamber 105 and the lower chamber 106. The exhaust shield 125 thus defines the top and lower chambers 105 and 106 and their boundaries.

The preferred exhaust shield 125 is in the form of a pan, being somewhat concave or dished. In practice, such a configuration lends itself to the collection of rain water entering the top chamber 105 through openings 116, 112 and 122, for instance.

The preferred heating appliance 100 includes a flue collector 127 below the lower chamber 106 and a flue guide 128 extending from that flue collector through the lower chamber and the exhaust shield 125 to the top chamber 105, for guiding flue products 115 into that top chamber.

The exhaust opening of the flue guide is protected by a wind collar 129 extending around that flue guide 128 in the top chamber 105 above the exhaust shield 125. The illustrated preferred embodiment of that wind collar 129 has a fustoconical configuration, having its inverted top at the flue guide 128 and its large base at a distance from the exhaust shield 125 in the top chamber 105. The wind collar 129 thus has slanted sides diverging upwardly away from the flue guide 128 and from the exhaust shield 125.

The illustrated embodiment of the heating appliance 100 also includes baffles, wind deflectors, and diverters in the lower chamber 106. For instance, the above mentioned means for sustaining combustion include a front wind deflector 131 behind the lower inlet openings 108 in the lower chamber 106 for guiding air from the received front part 109 of the wind 110 to the channel 74 and hence to the flames 64 at the burner 61. The front wind deflector 131 corresponds to the front panel of the top structure 102 having at least the inlet openings 108 therethrough.

A side wind deflector 133 extends in the lower chamber 106 behind the front wind deflector 131, as seen from the lower inlet openings 108.

The nature and function of deflectors 131 and 133 and of further wind diverters extending in the lower chamber 106 at predetermined angles with respect to front, side and rear portions of the top structure 102, will now be explained with the aid of several sketches showing only parts of the heating appliance 100 essential to improved wind resistance and performance.

Figure 7:
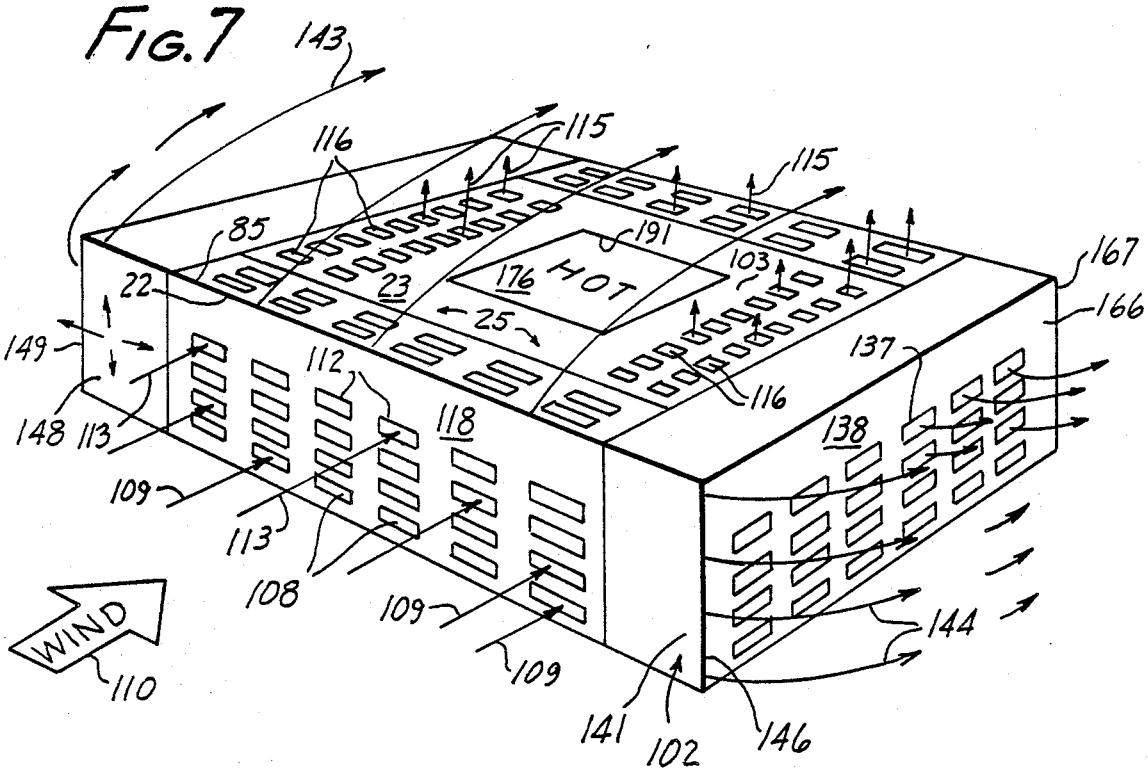
FIG. 7 is a perspective view of the top structure of the heating appliance according to FIG. 6.

To this end, FIGS. 7 et seq. only show top structure parts and components of the heating appliance 100.

Figure 8:
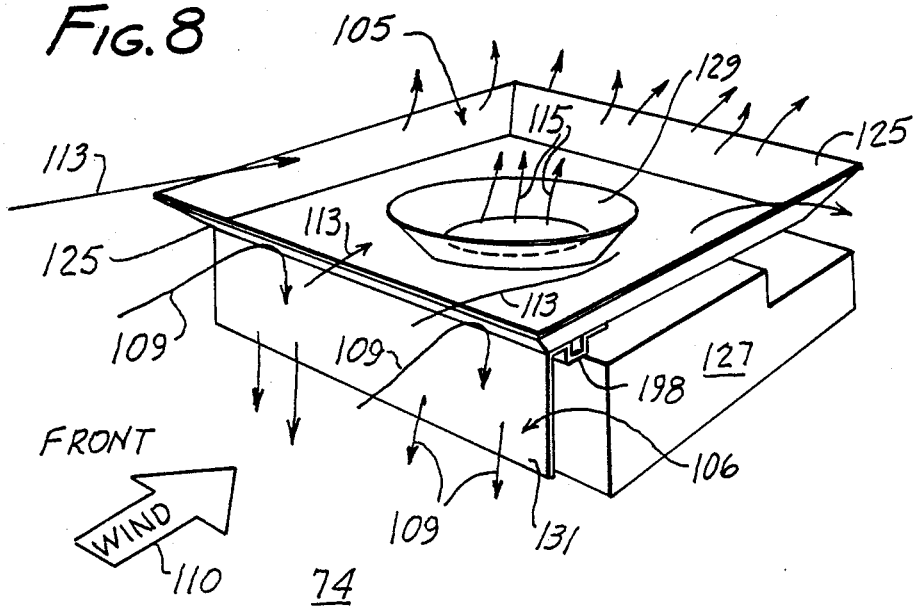
FIG. 8 is a detail view, in perspective, of the heating appliance of FIG. 6.

In particular, FIG. 7 shows wind and exhaust conditions around the heater top structure 102 in the case of a front wind 110, impinging on the front panel 118 of the top structure. In that case, the lower wind component 109, penetrating the lower inlet openings 108, impinges upon and is deflected by the slanted front of the exhaust shield 129 and by the vertical front wind deflector plate 131. The lower wind component 109 is thus directed downwardly into the channel 74, as shown in FIGS. 6 and 8, to sustain combustion at the flames 64 and otherwise benefit the operation of the heating appliance.

The upper wind component 113 enters the top chamber 105 through the top inlet openings 112 and sweeps along the exhaust shield 125 and the top of the structure 102 inside the surface 103.

The upwardly projecting and outwardly diverging wind collar 129 prevents the wind component 113 from interfering with the operation of the flue guide 128. In the illustrated preferred embodiment, the upper wind component 113 actually aids the exhaust function of the appliance, by sweeping flue products 115 through the exhaust openings 116 in the top surface 103 and through exhaust openings 122 in a rear panel 136 and through exhaust openings 137 in side panel 138 of the top structure 102. That reliable and wind-controlled exhaust of combustion products is aided by the airfoil 22 with its transverse straight edge 85 to provide the above mentioned underpressure outside of the exhaust openings 116.

In accordance with the preferred embodiment illustrated in FIG. 7, the side panel 138 of the top structure 102 is also preceded or provided with a stationary airfoil 141 for generating in the region of the lateral outlet openings 137, and in response to the front wind 110, an air pressure lower than the air pressure of that wind. In practice, this aids in the exhaustion of flue products through lateral openings 137. It may be noted in this respect that all airfoils 22, 141, etc., in the illustrated preferred embodiments form rectangular corners with the surface areas 12, 103, 138, etc., which they serve, and that their straight transverse edges 85, 146, etc., are the outer edges of such corners.

The currently discussed aspect of the invention thus subdivides a wind 110 into several components, of which at least one component, such as the component 109, sustains combustion inside the heating appliance, while the other components, such as components 113, 143 and 144, effect an exhaustion of flue products. According to the illustrated preferred embodiment of the invention, the several wind components cooperate with each other in an achievement of optimum performance of the heating appliance.

In the preferred embodiment of the heating appliance 100, the subdivision of the wind into lower and upper components 109 and 113 is effected with the exhaust shield 125 which could, for instance, also be called a wind divider for that purpose.

The subdivision of the wind into components 143 and 144, on the other hand, is effected by airfoils 22 and 141 with their straight edges 85 and 146 extending transversely to the direction of the wind 110 and on the outside of the top structure 102.

As shown in FIG. 7, a further vertical airfoil 148, corresponding to the airfoil 141, with a further vertical edge 149, corresponding to the edge 146, may be provided at the other side of the top structure 102, to aid an exhaust of flue products through openings corresponding to the outlet openings 137 in the side panel opposite the panel 138 shown in FIG. 7.

Without further adjustment, heating appliances according to the subject invention readily adapt themselves to all kind of wind conditions. In this respect, FIGS. 9 to 11 graphically illustrate operation of the heating appliance 100 in response to a side wind 151.

In that case, too, the exhaust shield 125 breaks up the side wind 151 into a lower component 153 penetrating lower inlet openings 154, and into an upper component 155 penetrating the upper inlet openings 137. As before, the lower wind component 153, shown also in FIGS. 10 and 11, sustains combustion and generates a positive pressure inside the heating appliance, as in the case of the front wind 110. To that end, the lower side wind component 154 is deflected by the slanted lateral surface of the exhaust shield 125, as well as by an oblique wind diverter 157 and the vertical side wind deflector 133. The lower side wind component 154 is thus diverted into the vertical channel 74 and hence to the flames 64 in to the burner region 51. A further oblique deflector 159 may be provided at the other side of the appliance, as shown in FIG. 11. That deflector 159 may be positioned as a counterpart of the deflector 154 for handling side winds approaching the top structure 102 from a direction opposite the side wind 151.

Upper and lower inlet openings corresponding to the openings 137 and 154 may be provided in the opposite side of the top heater structure 102, for handling side winds opposite to the side wind 151 in the manner herein specifically described for the side wind 151.

Further wind diverters 161 and 162 may be provided bilaterally of the flue collector 127, in order to optimize performance of the appliance in side and rear wind conditions. Generally speaking, an embodiment of the subject invention provides wind deflectors and diverters 131, 133, 157, 159, 161 and 162 extending in the lower chamber 106 at different predetermined angles with respect to front, side and rear portions 118, 136 and 138 of the top structure 102.

Figure 9:
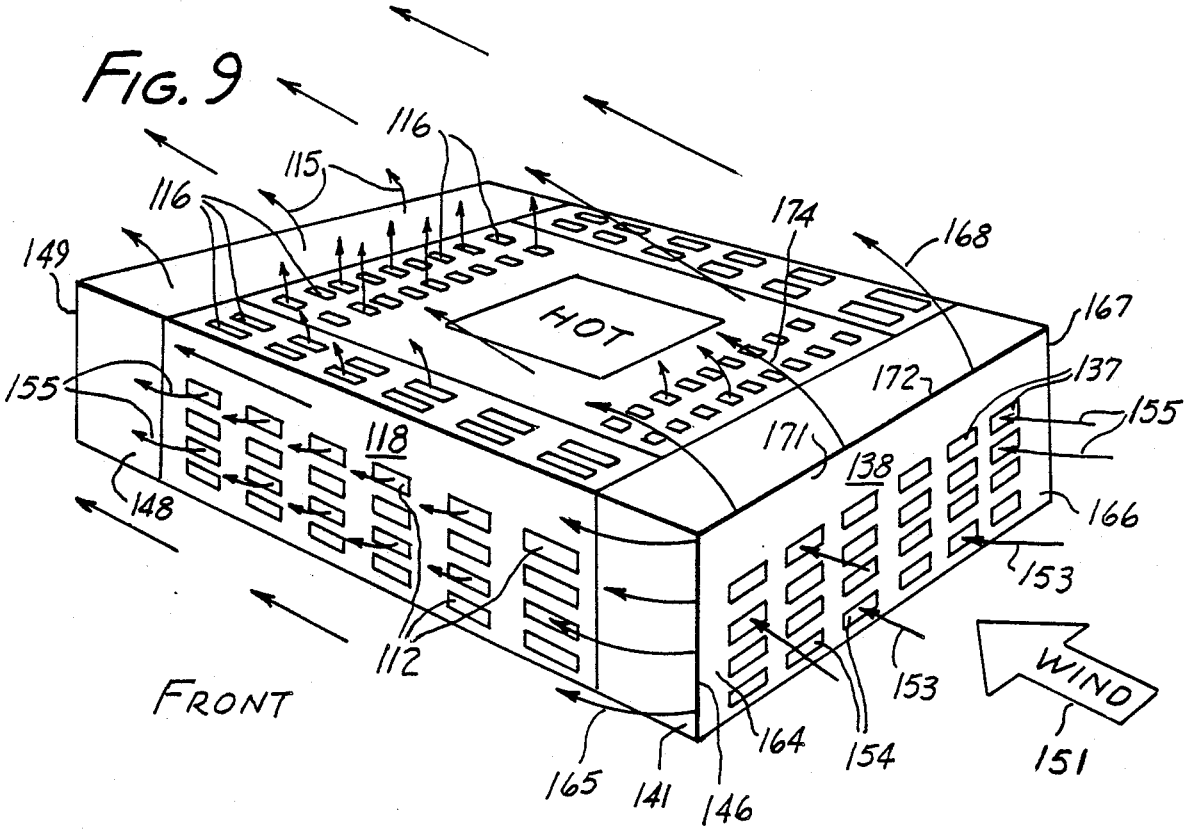
FIG. 9 is a view similar to FIG. 7 but showing operation under a different wind condition.
Figure 10:
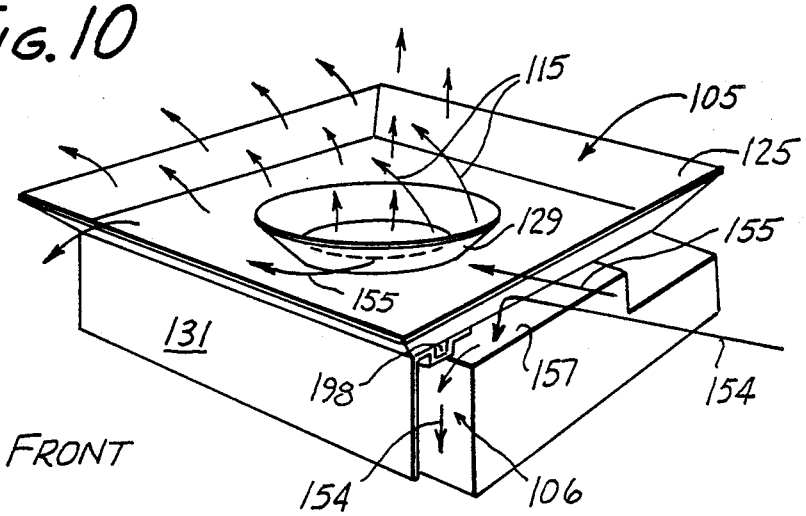
FIG. 10 is a detail view similar to FIG. 8 but showing operation under a different wind condition.
Figure 11:
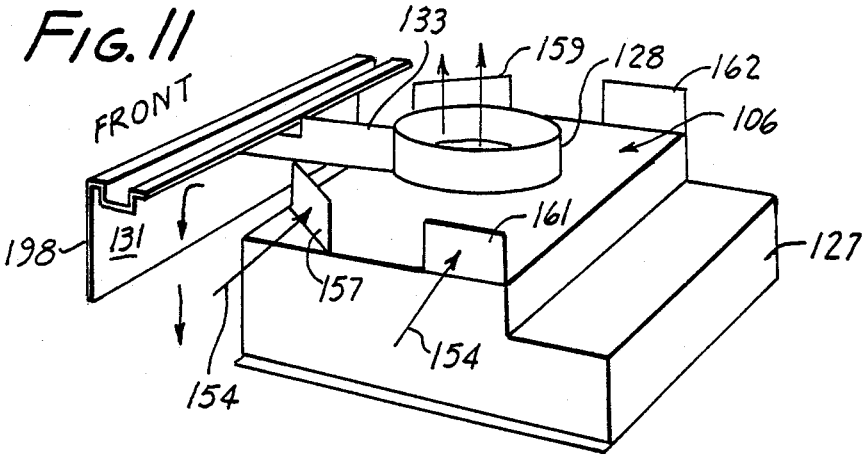
FIG. 11 is a detail view similar to FIGS. 8 and 10, but showing operation under yet another wind condition.

As seen in FIGS. 9 and 10, the upper side wind component 155, penetrating the upper side inlet openings 137, sweeps through the top chamber 105 and through the exhaust openings 116, entraining flue products 115 thereby. The upwardly projecting wind collar 129 again protects the exit of flue products from the flue guide 128.

The upper openings 112 in the front panel 118 act as exit openings for the upper wind component 155, with and without entrainment of flue products. Objectionable loss of the lower side wind components 153 through the lower openings 108 in the front panel 118 is prevented by the front wind deflector 131 projecting into the lower chamber 106.

An airfoil 164 shown in FIG. 9 shares the straight edge 146 with the previously described airfoil 141. That airfoil 164 with its straight edge 146 extracts from the side wind 151 a further component 165 which creates a lower pressure along the front panel 118 for an improved exhaust through openings 112. A similar airfoil 166 with its straight edge 167 extracts from the side wind 151 yet another component 168 which aids in an exhaust through openings 122 in the rear panel 136 of the top structure 102.

A further airfoil 171 and its straight edge 172 extend transversely to the airfoils 164 and 166 and their straight edges 146 and 167, and extend also transversely to the side wind 151, in order to extract therefrom a further component 174 for generating a low-pressure condition above the exhaust openings 116, for an improved exhaust of flue products 115 in response to the side wind 151.

The illustrated heating appliances according to preferred embodiments of the subject invention also work well under rear wind conditions, which is particularly important in the case of free-standing appliances and also in the case of units which are located near walls and buildings from which wind is reflected to the rear of the unit.

In this respect, FIG. 6 shows a rear wind 177 broken up by the exhaust shield 125 into an upper component 178 and lower component 179 penetrating, respectively, the upper inlet openings 122 and the lower inlet openings 121 in the rear panel 136 of the top structure 102.

The upper rear wind component 178 enters the top chamber 105 and aids in an exhaustion of flue products 115 in the manner already described for the front wind component 113. For further flue product exhaust assistance, the rear panel 136 may be provided with a further airfoil 181 which may have its straight edge 182 ahead of the top surface 103, in order to generate a lower pressure condition above the exhaust openings 116.

The upper rear wind component 178 acts reversely to the upper front wind component 113 with essentially the same effect in the exhaustion of flue products 115. Similarly, combustion is also sustained and positive pressure generated inside the heating appliance during rear wind conditions.

In particular, the lower rear wind component 179 enters the lower chamber 106 through the lower rear inlet openings 121. That entered lower rear wind component 179 sweeps through the lower chamber 106 past the flue guide 128 and is diverted at the rear surface of the front wind deflector 131 downwardly into the vertical channel 74. Lateral wind deflectors 161 and 162 and slanted diverters 157 and 159 assist the lower rear wind component 179 in reaching the deflector plate 131 and thus the vertical channel 74 to assist combustion at the flames 64 and generation of a positive pressure inside the heating appliance 100 for a reliable exhaustion of flue products 115, along with the above mentioned action of the upper rear wind component 178.

Figure 12:
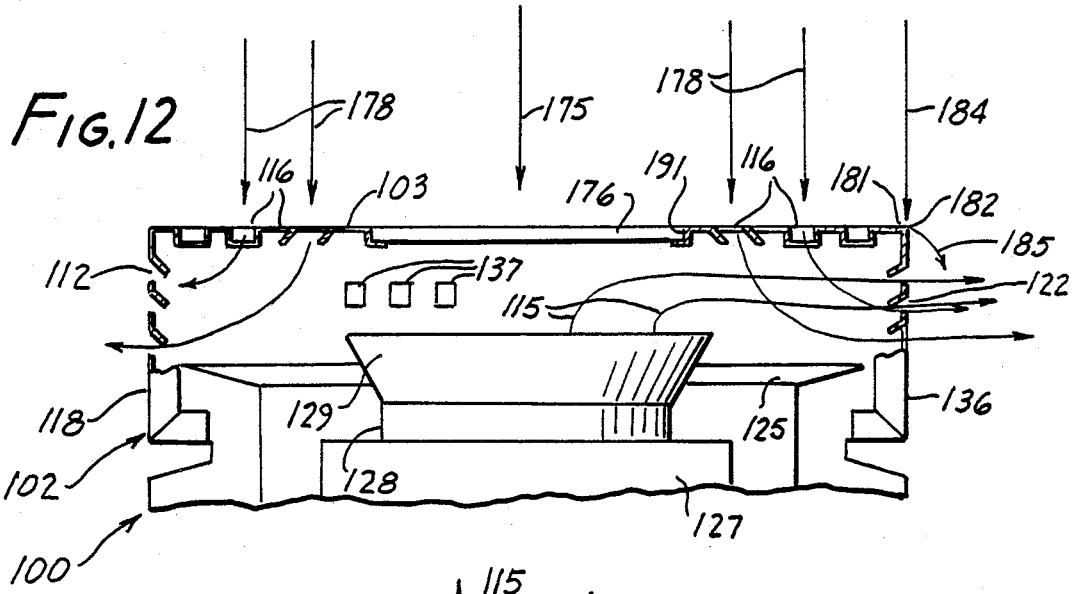
FIG. 12 is a detail view of the appliance of FIG. 6, showing operation under a downward condition.

The operation of the heating appliance 100 also is well protected during downdraft conditions. For instance, as shown in FIG. 12, the exhaust operation of the flue guide 128 is protected against a direct downwind 175 by an impervious plate 176 located above the outlet opening of the flue guide 128. As seen in FIGS. 7 and 12, the plate 176 is a removable insert in the top 103 of the structure 102.

Components 178 of the downwind enter the top openings 116 of the structure 102 and are diverted sidewise by the exhaust shield 125 to the upper openings 112, 122 and 137 in the different sides of the top structure 102. In practice, air from downwind 178 can exit the top structure above the exhaust shield 125 at its front and back, as well as laterally; that is, on all four sides of the top structure. In doing so, the downwind 178 entrains flue products 115 leaving the flue guide 28 and wind collar 129. Proper exhaust of flue products thus continues during downwind conditions as well. At the same time, combustion at the burner 61 is sustained by air entering the lower chamber 106 through the above mentioned inlet openings 108 and traveling along the channel 14 to the flames 64.

During severe downdrafts, the above mentioned airfoil feature may also be employed to enhance the flue product exhaust function. For instance, one or more airfoils 181 with straight edges 182 may be provided at the top surface 103 preceding one or more of the side panels of the top structure. A downwind 184 impinging upon the airfoil 118 will thus generate a component 185 creating a region of lower pressure at the side openings, through which flue products 115 are exhausted.

The top structure may thus be provided with airfoils along all four sides of the top structure 102. Airfoils may also be provided along the tops of all four side panels of the structure 102. A pair of airfoils may also be provided along each vertical corner of the top structure 102. Each adjacent pair of airfoils preferably share a common straight edge 85, 146, 149, 167, 182, etc. which extends transversely to the particular wind direction for which it is provided.

Figure 13:
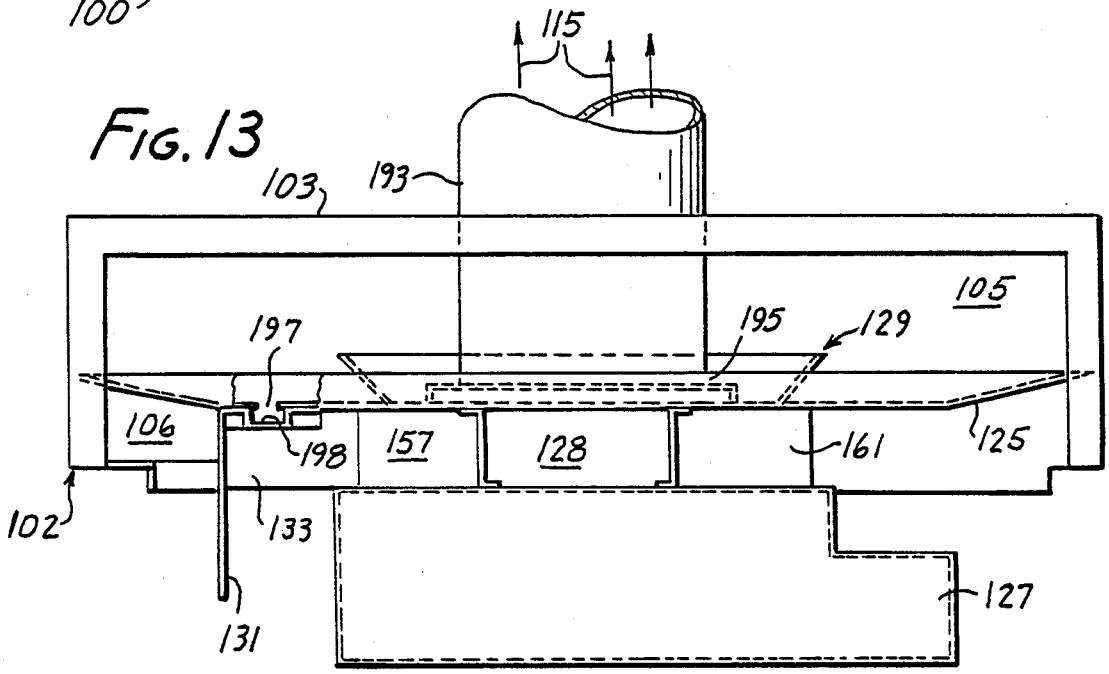
FIG. 13 is a detail view similar to FIG. 12 showing conversion of the heating appliance to indoor use, according to an embodiment of the invention.

As explained with the aid of FIG. 13, the subject invention also resides in a convertible indoor/outdoor heating appliance wherein internal flames 64 produce flue products 115.

In terms of organization and structure, the convertible indoor/outdoor heating appliance may, for instance, be the appliance shown in FIGS. 6 to 12 and shown also in FIG. 13 as converted to indoor use. That appliance has a pipe 128 extending from the flue collector 127 through the lower chamber 106 to the top chamber 105.

For indoor use, the top plate or insert 176 is removed or snapped out, leaving an opening 191, which may be square or rectangular, as shown in the drawings, or which alternatively may be round. Accordingly, in addition to the louvered exhaust openings 116, the exhaust openings in the top surface 103 of the top structure 102 now also include an opening 191 which accommodates the insert 176 during outdoor use of the appliance.

For indoor use, a chimney or flue stack 193 extends through the opening 191 and through the top chamber 105 of the top structure 102 to the pipe 128 for guiding flue products 115 away from the appliance through a wall or through the roof to an outside vent or chimney. In the embodiment shown in FIG. 13, a smoke stack adaptor 195 is provided on the exhaust shield 125 inside the wind collar 129 for receiving and connecting the smoke stack 193 to the flue collector 127 via flue guide or pipe 128.

It is a special advantage of the preferred embodiment of the invention illustrated with the aid of FIG. 13 that only the insert 176 needs to be removed for conversion of the appliance to indoor use by installation of the smoke stack 193, and that only this insert 176 needs to be replaced after removal of the smoke stack, for reconversion of the appliance to outdoor use. This is a significant advance over prior proposals, which went as far as reducing the number of components that needed to be exchanged for outdoor/indoor conversion of a gas-fired appliance to three components or assemblies, not counting the smoke stack itself.

According to the preferred embodiment of the invention illustrated in FIGS. 6 through 13, the insert 176 for selectively closing the aperture 191 when no flue stack is present, is the only component of the appliance 100 that needs to be removed or repositioned for indoor-/outdoor conversion of the appliance.

In this respect, it is within the scope of the subject invention that the smoke stack adaptor 195 may also be selectively installed and removed for indoor/outdoor conversion. However, it is equally within the scope of the subject invention that such an adaptor may be permanently present, whether the particular appliance is intended for indoor use or for outdoor use.

When the outlet opening 191 is closed by the insert 176 for outdoor use of the appliance, the further apertures 116 spaced laterally from the now closed aperture 191 serve the exhaustion of flue products 115 rom the top chamber 105, as described above for various wind conditions.

The exhaust shield 125 may include means for collecting rain water entering the top chamber through the exhaust openings 116. These include a hole 197 in the bottom of the pan-shaped exhaust shield 125, as well as a channel 198 extending behind and in parallel to the front wind diverter 139 for channeling rain water to a side of the appliance. In this manner, rain water or accidentally entered water from a garden hose or the like may be channeled to the outside of the appliance or to a hot portion inside the appliance where such water will evaporate.

It will thus be appreciated that the subject invention provides appliances which can handle all weather conditions and indoor/outdoor uses, including the four winds, downdrafts and smoke stack installations.

The subject extensive disclosure will render apparent or suggest to those skilled in the ar various modifications and variations within the spirit and scope of the subject invention and equivalents thereof.

We claim:

1. In a method of providing and operating an outdoor heating appliance wherein internal flames produce flue products inside a housing of said heating appliance, the improvement of rendering the operation of the heating appliance wind resistant, comprising in combination the steps of:

providing said heating appliance above said housing with a top structure having a top surface;

defining said top surface with a stationary airfold generating in a region above said top surface and in response to wind an air pressure lower than an air pressure of said wind;

providing below said top surface and said airfoil inlet openings for receiving part of said wind;

penetrating said top surface with exhaust openings for said flue products in said region, whereby said flue products are exhausted from said outdoor heating appliance by said wind; and sustaining combustion generating said flue products inside the heating appliance and imparting to said flue products a positive pressure toward the exhaust openings aiding exhaustion of said flue products during occurrence of said wind by providing wind deflectors or diverters inside said inlet openings and by guiding air from said received part of the wind with said wind deflectors or diverters into and through a channel in the heating appliance to said internal flames.

2. A method as claimed in claim 1, including the step of:

employing wind from part of said inlet openings for exhausting flue products through said exhaust openings in said top surface.

3. A method as claimed in claim 1, including the step of:

providing an additional inlet opening between said top structure and said housing of said heating appliance below said top structure.

4. A method as claimed in claim 1, including the steps of:

providing said housing of said heating appliance with a bottom and side walls below said top structure; and maintaining the bottom and all side walls of said housing closed below said top structure.

5. A method as claimed in claim 4, including the steps of:

providing inside said top structure below said exhaust openings a baffle structure for returning through part of said exhaust openings air penetrating another part of said exhaust openings during downward wind conditions.

6. A method as claimed in claim 1, including the steps of:

providing said housing of said heating appliance with a bottom and side walls below said top structure;

providing said inlet openings in a frontal side of said top structure below said top surface and said airfoil for receiving part of a frontal wind;

sustaining combustion and generating inside the heating appliance said positive pressure toward the exhaust openings during said frontal wind by guiding air from said received part of the frontal wind through said channel in the heating appliance to said internal flames;

providing between lateral sides of said top structure and said housing second inlet openings for receiving air from side winds; and sustaining combustion and generating inside the heating appliance said positive pressure toward the exhaust openings during said winds by guiding air received from said side winds in the heating appliance to said internal flames.

7. A method as claimed in claim 6, including the step of:

maintaining the bottom and all the side walls of said housing closed below said top structure.

8. A method as claimed in claim 1, wherein:

said airfoil is provided at said top surface with a straight edge extending transversely to said wind for generating said lower air pressure.

9. In a method of providing and operating an outdoor heating appliance wherein internal flames produce flue products, the improvement of rendering the operating of the heating appliance wind resistant, comprising in combination the steps of:

providing said heating appliance with a top structure having a top surface;

dividing said top structure into a top chamber extending below said top surface and a separate lower chamber located below said top chamber;

providing wind diverters in said lower chamber at predetermined angles with respect to front, side and rear portions of said top structure;

providing lower inlet openings in communication with said lower chamber for receiving a first part of said wind;

sustaining combustion generating said flue products inside the heating appliance and imparting to said flue products a positive pressure aiding exhaustion of said flue products during occurrence of said wind by guiding air from said received first part of the wind with said wind diverters through part of said lower chamber and into a channel in the heating appliance to said internal flames;

providing upper inlet openings in communication with said top chamber for receiving a second part of said wind;

guiding said first products into said top chamber; and penetrating said top surface with exhaust openings for said flue products and employing wind from said second part for exhausting said flue products from said top chamber through said exhaust openings.

10. A method as claimed in claim 9, including the step of:

providing said upper and lower inlet openings in a side of said top structure.

11. A method as claimed in claim 9, including the step of:

distributing said upper and lower inlet openings among more than one side of said top structure.

12. A method as claimed in claim 9, wherein:

said heating appliance has a housing having a bottom and side walls below said top structure; and said bottom and all side walls of said housing are maintained closed below said top structure during operation of said heating appliance.

13. A method as claimed in claim 9, including the steps of:

providing said top surface with a stationary airfoil generating in a region above said exhaust openings in the top surface and in response to wind an air pressure lower than an air pressure of said wind for exhausting flue products through said exhaust openings.

14. A method as claimed in claim 13, wherein:

said airfoil is provided at said top surface with a straight edge extending transversely to said wind for generating said lower air pressure.

15. In an outdoor heating appliance wherein internal flames produce flue products inside a housing of said heating appliance, the improvement for rendering the operation of the heating appliance wind resistant, comprising in combination:

a top structure for said heating appliance above said housing having a top surface;

a stationary airfoil on said top surface for generating in a region above said top surface and in response to wind an air pressure lower than an air pressure of said wind;

inlet openings below said top surface and said airfoil for receiving part of said wind;

means for sustaining combustion generating said flue products inside the heating appliance and for imparting to said flue products a positive pressure toward the exhaust openings aiding exhaustion of said flue products during occurrence of said wind, including a channel for guiding air from said received part of the wind to said internal flames;

exhaust openings for said flue products penetrating said top surface in said region, whereby said flue products are exhausted from said outdoor heating appliance;

means for dividing said top structure into a top chamber extending below said exhaust openings and a separate chamber communicating with said channel; and said means for sustaining combustion and for imparting said positive pressure including wind diverters extending in said separate chamber between said inlet openings and said channel at predetermined angles with respect to front, side and rear portions of said top structure.

16. An appliance as claimed in claim 15, wherein:

part of said inlet openings communicate with said exhaust openings through a chamber in said top structure.

17. An appliance as claimed in claim 15, including:

an additional inlet opening between said top structure and said housing of said heating appliance below said top structure.

18. An appliance as claimed in claim 15, wherein:

said housing for said heating appliance has a bottom and side walls below said top structure;

said appliance including means for maintaining the bottom and all side walls of said housing closed below said top structure.

19. An appliance as claimed in claim 18, including:

a baffle structure inside said top structure and below said exhaust openings for returning through part of said exhaust openings air penetrating another part of said exhaust openings during downward wind conditions.

20. An appliance as claimed in claim 15, wherein:

said housing for said heating appliance has a bottom and side walls below said top structure;

said inlet openings being in a frontal side of said top structure below said top surface and said airfoil;

second inlet openings being between lateral sides of said top structure and said housing for receiving air from side winds; and said means for sustaining combustion including a second channel for guiding air received from said side winds to said internal flames.

21. An appliance as claimed in claim 20, including:

means for maintaining the bottom and all the side walls of said housing closed below said top structure.

22. An appliance as claimed in claim 15, wherein:

said airfoil has a straight edge at said top surface extending transversely to said wind for generating said lower air pressure.

23. In an outdoor heating appliance wherein internal flames produce flue products inside a housing of said heating appliance, the improvement of rendering the operation of the heating appliance wind resistant, comprising in combination:

a top structure for said heating appliance above said housing having a top surface;

means for dividing said top structure into a top chamber extending below said top surface and a separate lower chamber located below said top chamber, said means for dividing the top structure include an exhaust shield extending inside said top structure from front to back and from side to side between said top chamber and said lower chamber;

said top structure has openings in sides thereof divided by said exhaust shield into upper inlet openings in communication with said top chamber for receiving a second part of the wind and lower inlet openings in communication with said lower chamber for receiving a first part of the wind;

means for sustaining combustion generating said flue products inside the heating appliance and imparting to said flue products a positive pressure aiding exhaustion of said flue products during occurrence of said wind, including a channel in the heating appliance for guiding air from said received first part of the wind through part of said lower chamber to said internal flames;

exhaust openings in said top surface; and means for guiding flue products into said top chamber for exhaustion of said flue products from said top chamber through said exhaust openings with wind from said second part.

24. An appliance as claimed in claim 23, wherein:

said upper and lower inlet openings are in a side of said top structure.

25. An appliance as claimed in claim 23, wherein:

said upper and lower inlet openings are distributed among more than one side of said top structure.

26. An appliance as claimed in claim 23, wherein:

said housing for said heating appliance has a bottom and side walls below said top structure; and said appliance including means for maintaining the bottom and all side walls of said housing closed below said top structure during operation of said heating appliance.

27. An appliance as claimed in claim 23, including:

a stationary airfoil preceding said top surface and generating in a region above said exhaust openings in the top surface and in response to wind an air pressure lower than an air pressure of said wind for exhausting flue products through said exhaust openings.

28. An appliance as claimed in claim 27, wherein:

said airfoil has a straight edge at said top surface extending transversely to said wind for generating said lower air pressure.

29. An appliance as claimed in claim 23, wherein:

said exhaust shield is in the form of a pan.

30. An appliance as claimed in claim 23, wherein:

said exhaust shield includes means for collecting rain water entering the top chamber through said exhaust openings.

31. An appliance as claimed in claim 23, including:

wind deflectors and diverters in said lower chamber.

32. An appliance as claimed in claim 23, wherein:

said top structure includes a front panel having at least said lower inlet openings therethrough; and said means for sustaining combustion includes a front wind deflector behind said lower inlet openings in said lower chamber for guiding air from said received front part of the wind to said channel.

33. An appliance as claimed in claim 32, including:

a side wind deflector extending in said lower chamber at right angles to said front wind deflector behind said front wind deflector, as seen from said lower inlet openings.

34. In an outdoor heating appliance wherein internal flames produce flue products, the improvement of rendering the operation of the heating appliance wind resistant, comprising in combination:

a top structure for said heating appliance having a top surface;

means for dividing said top structure into a top chamber extending below said top surface and a separate lower chamber located below said top chamber, said means for dividing the top structure include an exhaust shield extending inside said top structure from front to back and from side to side between said top chamber and said lower chamber;

lower inlet opening in communication with said lower chamber for receiving a first part of the wind;

means for generating said flue products inside the heating appliance and imparting to said flue products a positive pressure aiding exhaustion of said flue products during occurrence of said wind, including a channel in the heating appliance for guiding air from said received first part of the wind through part of said lower chamber to said internal flames;

upper inlet openings in communication with said top chamber for receiving a second part of the wind;

exhaust openings in said top surface; and means for guiding the flue products into the top chamber for exhaustion of said flue products from said top chamber through said exhaust openings with wind from said second part including a flue collector below said lower chamber and a flue guide extending from said flue collector through said lower chamber and said exhaust shield to said top chamber.

35. An appliance as claimed in claim 34, wherein:

said exhaust shield carries a wind collar extending around said flue guide in said top chamber.

36. In an outdoor heating appliance wherein internal flames produce flue products, the improvement of rendering the operation of the heating appliance wind resistant, comprising in combination:

a top structure for said heating appliance having a top surface;

means for dividing said top structure into a top chamber extending below said top surface and a separate lower chamber located below said top chamber;

lower inlet openings in communication with said lower chamber for receiving a first part of the wind;

means for sustaining combustion and generating inside the heating appliance positive pressure during said wind, including a channel in the heating appliance for guiding air from said received first part of the wind through part of said lower chamber to said internal flames;

upper inlet openings in communication with said top chamber for receiving a second part of the wind;

exhaust openings in said top surface; means for guiding flue products into said top chamber for exhaustion of said flue products from said top chamber through said exhaust openings with wind from said second part; and wind diverters extending in said lower chamber at predetermined angles with respect to front, side and rear portions of said top structure.

37. In a convertible indoor/outdoor heating appliance wherein internal flames produce flue products, comprising in combination the steps of:

a top structure for said heating appliance having a top surface;

means for dividing said top structure into a top chamber extending below said top surface and a separate lower chamber located below said top chamber;

lower inlet openings in communication with said lower chamber for receiving air from outside said appliance;

means for sustaining combustion inside the said appliance including wind deflectors or diverters in said lower chamber and a channel in said appliance for guiding air from said inlet openings through part of said lower chamber to said internal flames;

means for guiding flue products to said top chamber including a flue collector below said lower chamber and a pipe extending from said flue collector through said lower chamber to said top chamber; and exhaust openings in said top surface.

38. An applicance as claimed in claim 37, wherein:

said exhaust openings include an aperture through said top structure for receiving a flue stack extending through said top chamber to said pipe for guiding flue products away from said applicance.

39. An appliance as claimed in claim 38, including:

means for selectively closing said aperture when no flue stack is present;

said exhaust openings including further apertures spaced laterally from the first-mentioned aperture for exhaustion of flue products from said top chamber through said further exhaust openings.

40. An appliance as claimed in claim 39, including:

further inlet openings in communication with said top chamber for receiving a part of the wind for exhaustion of flue products from said top chamber with said part of the wind.

41. An appliance as claimed in claim 40, wherein:

the first-mentioned and said further inlet openings are in a side of said top structure.

42. An appliance as claimed in claim 40, wherein:

the first-mentioned and said further inlet openings are distributed among more than one side of said top structure.

43. An appliance as claimed in claim 37, including:

a housing for said heating appliance having a closed bottom and side walls below said top structure; and means for maintaining the bottom and all side walls of said housing closed below said top structure during operation of said heating appliance.

44. An appliance as claimed in claim 37, including:

a stationary airfoil preceding said top surface and generating in a region above said further apertures and in response to wind an air pressure lower than an air pressure of said wind for exhausting flue products through said further apertures.

45. An appliance as claimed in claim 44, wherein:

said airfoil has a straight edge at said top surface extending transversely to said wind for generating said lower air pressure.

46. An appliance as claimed in claim 37, wherein:

said means for dividing the top structure include an exhaust shield extending inside said top structure from front to back and from side to side between said lower chamber and said top chamber.

47. An appliance as claimed in claim 46, wherein:

said exhaust shield is in the form of a pan.

48. An appliance as claimed in claim 46, wherein;

said exhaust shield includes means for collecting rain water entering the top chamber through said exhaust openings.

49. An appliance as claimed in claim 37, wherein:

said wind deflectors and diverters in said lower chamber include a front wind deflector behind said inlet openings in said lower chamber for guiding air to said channel, and a side wind deflector extending in said lower chamber at right angles to said front wind deflector behind said front wind deflector, as seen from said inlet openings.

50. An appliance as claimed in claim 37, wherein:

said top structure includes a front panel having the inlet openings therethrough; and said wind deflectors include a front wind deflector behind said inlet openings in said lower chamber for guiding air to said channel.

51. An appliance as claimed in claim 37, wherein:

said wind diverters extend in said lower chamber at predetermined angles with respect to front, side and rear portions of said top structure.

52. In a convertible indoor/outdoor heating appliance wherein internal flames produce flue products, the improvement comprising in combination:

a top structure for said heating appliance having a top surface;

means for dividing said top structure into a top chamber extending below said top surface and a separate lower chamber located below said top chamber, said means for dividing the top structure including an exhaust shield extending inside said top structure from front to back and from side to side between said lower chamber and said top chamber;

lower inlet openings in communication with said lower chamber for receiving air from outside said appliance;

means for sustaining combustion inside the said appliance including as channel in said appliance for guiding air from said inlet openings through part of said lower chamber to said internal flames;

means for guiding flue products to said top chamber including a flue collector below said lower chamber and a pipe extending from said flue collector through said lower chamber to said top chamber;

exhaust openings in said top surface for exhaustion of flue products from said appliance; and said exhaust shield carrying a wind collar extending around said pipe in said top chamber.

53. In a convertible indoor/outdoor heating appliance wherein internal flames produce flue products, the improvement comprising in combination:

a top structure for said heating appliance having a top surface and including a front panel having inlet openings therethrough;

means for dividing said top structure into a top chamber extending below said top surface and a separate lower chamber located below said top chamber in communication with said inlet openings for receiving air from outside said appliance;

means for sustaining combustion inside the said appliance including a channel in said appliance for guiding air from said inlet openings through part of said lower chamber to said internal flames and including a front wind deflector behind said inlet openings in said lower chamber for guiding air to said channel, and a side wind deflector extending in said lower chamber at right angles to said front wind deflector behind said front wind deflector, as seen from said inlet openings;

means for guiding flue products to said top chamber including a flue collector below said lower chamber and a pipe extending from said flue collector through said lower chamber to said top chamber; and exhaust openings in said top surface for exhaustion of flue products from said appliance.

* * * * *